US007295790B2

(12) United States Patent
Morimoto et al.

(10) Patent No.: US 7,295,790 B2
(45) Date of Patent: Nov. 13, 2007

(54) IMAGE FORMING APPARATUS AND CONTROL METHOD

(75) Inventors: Yasukazu Morimoto, Tochigi (JP); Nobuhiro Moteki, Tochigi (JP); Hideo Saitou, Tochigi (JP)

(73) Assignee: Matsushita Electric Industrial Co, Ltd., Osaka (JP)

( * ) Notice: Subject to any disclaimer, the term of this patent is extended or adjusted under 35 U.S.C. 154(b) by 146 days.

(21) Appl. No.: 11/188,870

(22) Filed: Jul. 26, 2005

(65) Prior Publication Data

US 2006/0045555 A1 Mar. 2, 2006

(30) Foreign Application Priority Data

Sep. 2, 2004 (JP) ..... P2004-256008

(51) Int. Cl.
*G03G 15/00* (2006.01)
*G03G 21/04* (2006.01)

(52) U.S. Cl. ..... 399/80; 399/366

(58) Field of Classification Search ..... 399/38, 399/75, 80, 82, 85, 366
See application file for complete search history.

(56) References Cited

U.S. PATENT DOCUMENTS

| | | | | |
|---|---|---|---|---|
| 5,694,222 | A | 12/1997 | Yamada | |
| 6,694,115 | B2 * | 2/2004 | Weaver | 399/80 |
| 6,782,217 | B1 * | 8/2004 | Ando | 399/366 X |
| 2003/0142990 | A1 | 7/2003 | Weaver | |

FOREIGN PATENT DOCUMENTS

| | | |
|---|---|---|
| JP | 2003-160117 | 6/2001 |
| JP | 2003-050525 | 2/2003 |
| JP | 2004-194268 | 7/2004 |
| JP | 2004-223989 | 8/2004 |

OTHER PUBLICATIONS

English Language Abstract JP 2004-194268.
English Language Abstract JP 2004-223989.
English Language Abstract of JP 2003-050525.
English Language Abstract of JP 2001-160117.

* cited by examiner

*Primary Examiner*—Sandra L. Brase
(74) *Attorney, Agent, or Firm*—Greenblum & Bernstein, P.L.C.

(57) ABSTRACT

The image forming apparatus detects a predetermined image data included in image data and transmits an electromagnetic signal to a memory card within a predetermined vicinity of the image forming apparatus. The memory card is configured to carried by a user of the image forming apparatus. The image forming apparatus receives identification information of the user from the memory card and has a memory which stores predetermined function information. The predetermined function information is associated with to the identification information of a predetermined user and defines functions of the image forming apparatus which the predetermined user is authorized to use. When the predetermined image data is detected by the detector, the image forming apparatus restricts the functions of the image forming apparatus based on the predetermined function information associated with the identification information of the predetermined user.

11 Claims, 13 Drawing Sheets

Fig.6

<Registration information of a memory card>

| Personal identification information (user ID) |
| --- |

Fig.7

<Personal information table on server side>

| |
|---|
| Personal identification information (user ID) |
| Personal information (name,department,assigned to,ID code,etc) |
| Restricted function information |
| Utilized function history information |
| |

Fig.8

| Function name | Function | Utilization decision information | | | | Remarks |
|---|---|---|---|---|---|---|
| | | Normal image | Color image | Image A | Image B | |
| Copy | Color copy | — | × | ○ | ○ | |
| | Monochrome copy | ○ | ○ | ○ | ○ | |
| | Double-sided copy | ○ | × | ○ | ○ | |
| | N in 1 copy | ○ | × | ○ | ○ | |
| | Resolution restriction | 1200 | 1200 | 1200 | 1200 | |
| FAX | Outside line transmission | ○ | × | × | × | Judge by FAX number |
| | Inside line transmission | ○ | × | × | × | Judge by FAX number |
| | Restrict number of prints to send | 10 | × | × | × | Number of prints(numeric value) |
| Internet FAX/E-Mail | Send to address inside company | ○ | × | ○ | ○ | Judge by destination e-mail address |
| | Send to address outside company | ○ | × | ○ | × | Judge by destination e-mail address |
| | Encode transmission data | ○ | × | ○ | ○ | |
| Scanner | Color scanner | — | ○ | ○ | ○ | |
| | Monochrome scanner | ○ | ○ | ○ | ○ | |
| | Resolution restriction | 1200 | 1200 | 1200 | 1200 | 1200/600/400/200/100 or less |
| File | Color file | — | ○ | ○ | ○ | |
| | Monochrome file | ○ | ○ | ○ | ○ | |
| | Resolution restriction | 1200 | 600 | 1200 | 1200 | |

Fig.11

| Date | User ID | Type of image date | Utilized function |
|---|---|---|---|
| 04.8.25 | 0825abX | Specific image dataA | Copy/color copy |
| 04.8.28 | 0825abX | Color image data | Scanner/color scanner |
| | | ⋮ | ⋮ |

IMAGE FORMING APPARATUS AND CONTROL METHOD

BACKGROUND OF THE INVENTION

1. Field of the Invention

The present invention relates to an image forming apparatus that restricts functions that can be utilized for specific documents, such as confidential documents, and to a method for controlling the image forming apparatus.

2. Description of Related Art

In recent years, image forming apparatuses (such as printers, FAX, copiers, and multifunction machines) improve the image quality of image forming apparatuses and increase a number of functions included in the apparatuses. The image forming apparatuses restrict functions (such as an image forming process) that can be utilized for specific documents which contain specific document images, such as confidential documents or color documents, based on the user.

For example, when a specific document image is included in document image data read by a scanner unit of a color copier, the color copier prohibits a printer unit from reproducing the document image. A control center receives communication from a user of the color copier in a reproduction prohibited state, notifies the user of a password for the color copier. After that, the user enters a predetermined password into the color copier. The color copier then releases the prohibited reproduction and reproduces the document image (refer to Related Art 1 for an example).

Another copier has a reader/writer which can read RFID (Radio Frequency Identification) cards that can be carried by users as well as RFID sheets attached to confidential documents. The copier reads the RFID sheets of the documents set in the copier and RFID cards of users standing in the front of the copier. The copier is controlled to allow reproductions of these documents only when the access rights of the users read from the user's RFID card is higher than the level of confidentiality of the documents read from the RFID sheet of the documents set in the copier (refer to Related Art 2 for an example).

[Related Art 1] Japanese Patent Laid-open Publication 2003-050525 (FIG. 1)

[Related Art 2] Japanese Patent Laid-open Publication 2001-160117 (FIG. 2)

However, the following problems occurred in the conventional technologies.

The conventional copier required complicated operations of the user. In other words, when specific document images were included in the read document image data, the copier prohibited the printer unit from reproducing the document image data. The copier waited for the input of the password by the user to reproduce the document image data. Thus, the user had to contact the control center, and then the user had to enter, into the copier, the password received from the control center. These operations were very complicated for the user.

The another conventional copier also required complicated operations of the user. Further, the another copier increased cost. Only when the access rights of a user read from the user's RFID card was higher than the level of confidentiality of the documents read from the RFID of the documents set in the copier, the copier allowed reproductions of these documents. Thus, RFID sheets had to be attached to specific documents. This increased cost. Furthermore, this problem also reduced the quality of the specific documents.

SUMMARY OF THE INVENTION

The object of the present invention is to take the problems mentioned above into consideration, and to provide an image forming apparatus and a method for controlling the image forming apparatus that can restrict the utilization of functions, such as an image forming process, for specific documents that include specific document images for each user, using a simple and low-cost method without the need for troublesome actions taken by users.

The image forming apparatus detects a predetermined image data included in image data and transmits an electromagnetic signal to a memory card within a predetermined vicinity of the image forming apparatus. The memory card is configured to be carried by a user of the image forming apparatus. The image forming apparatus receives identification information of the user from the memory card. The image forming apparatus also comprise a memory which stores a predetermined function information. The predetermined function information is associated with the identification information of a predetermined user and defines functions of the image forming apparatus which the0 predetermined user is authorized to use. The image forming apparatus comprises a controller which, when the predetermined image data is detected by the detector, restricts the functions of the image forming apparatus, based on the predetermined function information stored in the memory that is related to the identification information of the predetermined user received by the sensor.

BRIEF DESCRIPTION OF THE DRAWINGS

The present invention is further described in the detailed description which follows, with reference to the noted plurality of drawings by way of non-restricting examples of exemplary embodiments of the present invention, in which like reference numerals represent similar parts throughout the several views of the drawings, and wherein:

FIG. 3 (*b*) shows an example of sample data of predetermined image data stored in the predetermined image data memory of the image processing unit related to the above-mentioned embodiment;

FIG. 3 (*c*) shows an example of sample data of predetermined image data stored in the predetermined image data memory of the image processing unit related to the above-mentioned embodiment;

FIG. 6 shows registration information of a memory card read and written to by the multifunction machine related to the above-mentioned embodiment;

FIG. 7 shows the data structure of a personal information table registered in a server (personal information server) connected to the multifunction machine related to the above-mentioned embodiment;

FIG. 8 shows an example of restricted function information contained in a personal information table registered in a personal information server connected to the multifunction machine related to the above-mentioned embodiment;

FIG. 11 shows an example of a utilized function history registered in a utilized function history table provided in a personal information table of a personal information server connected to the multifunction machine related to the above-mentioned embodiment;

DETAILED DESCRIPTION OF PREFERRED EMBODIMENTS

The embodiments of the present invention are explained in the following, in reference to the above-described drawings.

Figure 1:
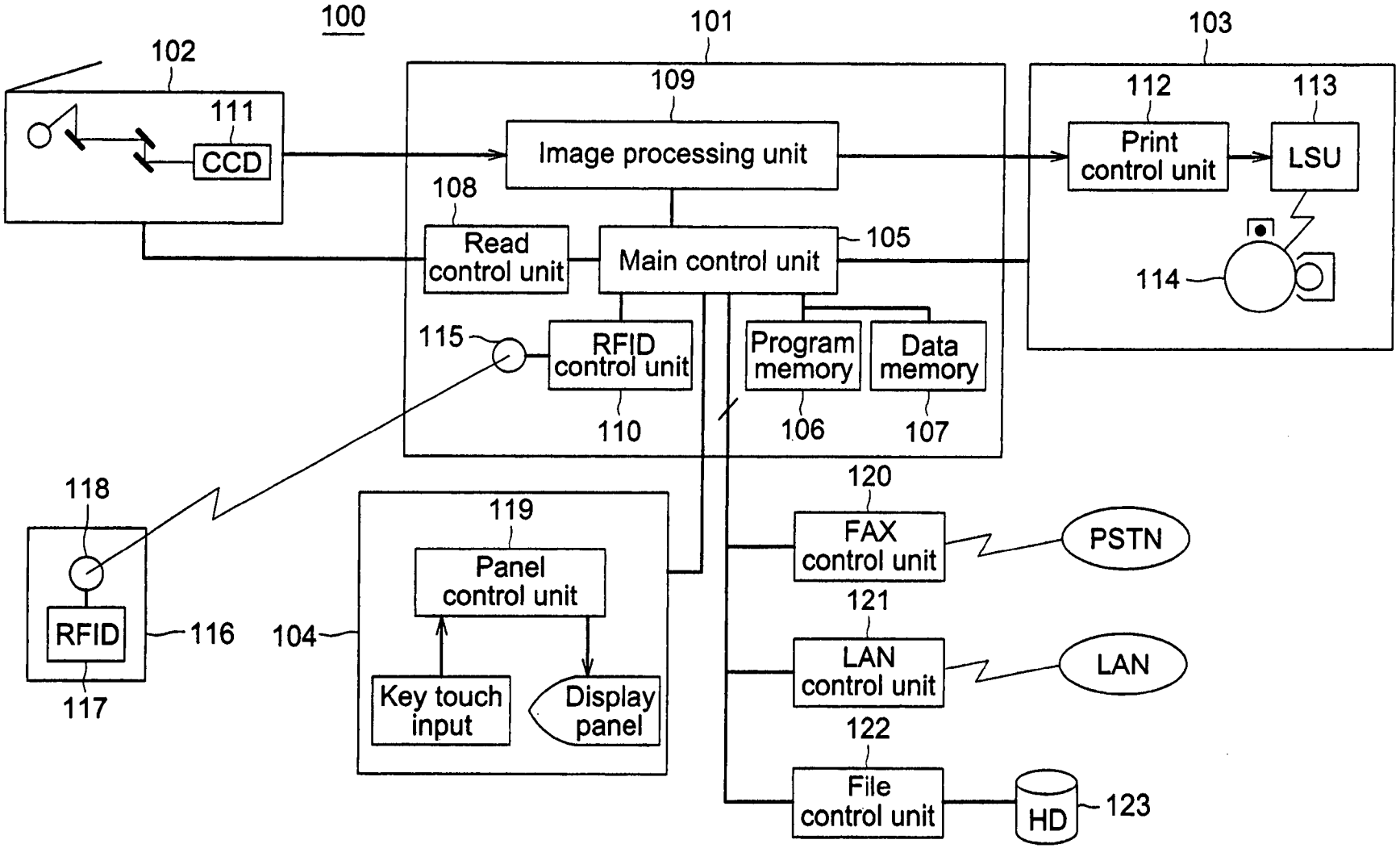
FIG. 1 is a block diagram showing the principal configuration of the multifunction machine in which is installed the control process device related to this embodiment.

FIG. 1 is a block diagram showing the principal configuration of the multifunction machine 100 in which is installed the control process device related to this embodiment.

As shown in this figure, the multifunction machine 100 related to this embodiment includes a control process device 101. The control process device 101 controls the entire machine as well as processes such as image processing of image data that was entered. The multifunction machine 100 comprises a reader 102 that reads documents loaded on the copyboard, a printer 103 that prints image data read by the reader 102 or image data received through a LAN, and a panel 104 that receives operation inputs from users to the multifunction machine 100 and also displays the current status.

The control process device 101 includes a main control unit 105, a program memory 106, a data memory 107, a read control unit 108, an image processing unit 109, and an RFID control unit 110.

The main control unit 105 controls the control process device 101 as well as the entire multifunction machine 100. During each type of control, the main control unit 105 reads control programs stored in the program memory 106. The data memory 107 is used as a work area while executing the control programs. The read control unit 108 controls the reader 102 under the control of the main control unit 105.

The image processing unit 109 judges whether or not predetermined image data (described later) exists in image data output from a CCD sensor 111 of the reader 102. The image processing unit 109 also performs image conversion processing in response to that predetermined image data. Image data for which image processing is performed by the image processing unit 109 is input into a printing control unit 112 of the printer 103 and then is developed on the surface of a photosensitive drum 114 through LSU 113.

The RFID control unit 110 has an antenna 115 and reads identification information of users registered in a memory card 116 carried by users who enter a detection vicinity. An RFID chip 117 is installed inside the memory card 116 and sends data (hereinafter referred to as suitable "registration data") registered in the card to the RFID control unit 110 through an antenna 118.

The panel 104 includes a panel control unit 119 that controls the entire panel device under the control of the main control unit 105. The panel control unit 119 receives input from operation keys and a large touch panel while controlling the display in the display panel of the touch panel.

The multifunction machine 100 includes a FAX control unit 120, a LAN control unit 121, and a file control unit 122. The FAX control unit 120, LAN control unit 121, and file control unit 122 control the following under the control of the main control unit 105. The FAX control unit 120 controls the communication of facsimile data through PSTN. The LAN control unit 121 controls the communication between the server and personal computers (hereinafter referred to as PC) connected to the LAN.

Figure 2:
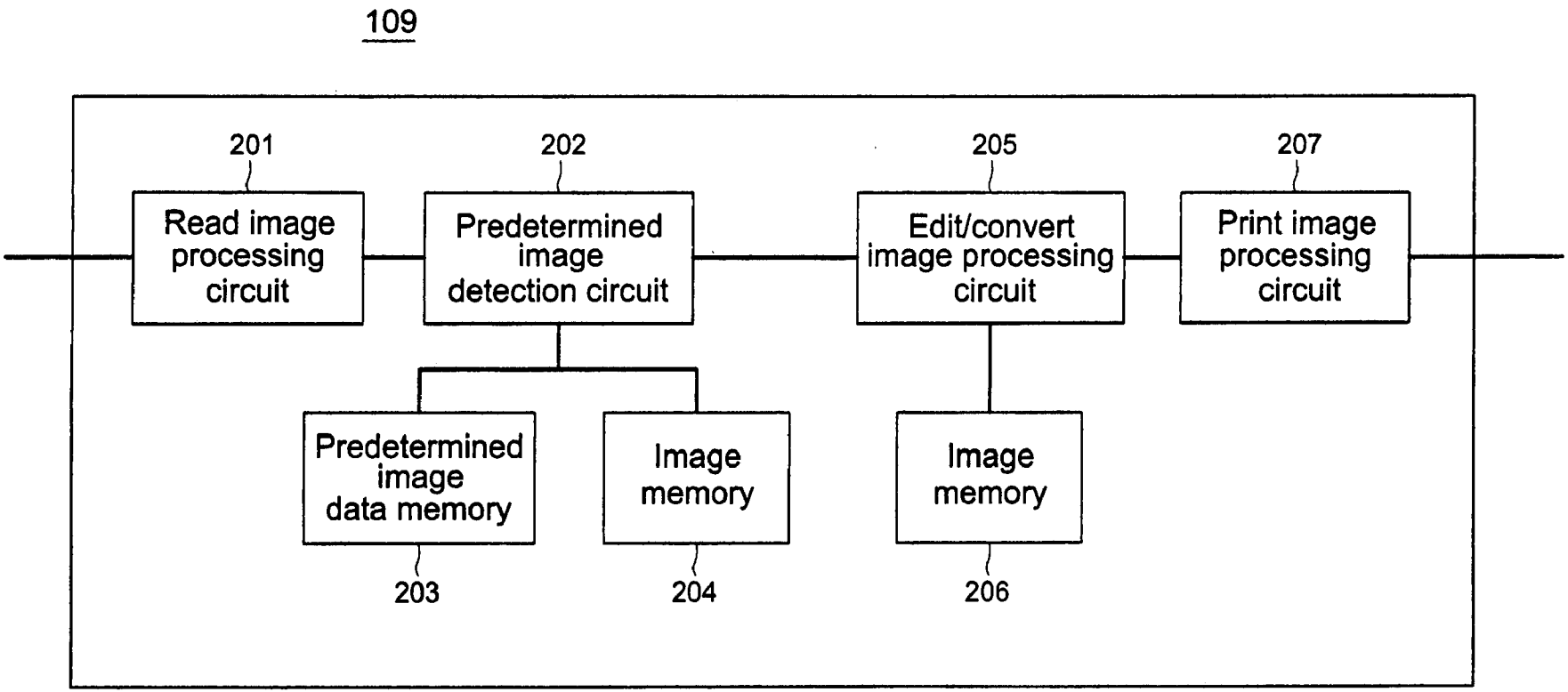
FIG. 2 is a block diagram showing the configuration of the image processing unit that includes the control process device related to the above-mentioned embodiment.

FIG. 2 is a block diagram showing the configuration of the image processing unit 109 that includes the control process device 101 related to this embodiment.

An image read processing circuit 201 in the image processing unit 109 shown in this figure performs shading correction processing and scanner conversion processing for image data received from the reader 102. The shading correction processing corrects for uneven light quantities and unbalanced characteristics of the CCD sensor 111. The scanner conversion processing converts read image data from reflectance ratio data to density data for easy handling by the printer 103.

A specific image detection circuit 202 detects predetermined image data in image data received from the image read processing circuit 201. Predetermined image data is image data that indicates restricting of each function in the multifunction machine 100. For example, predetermined image data comprises image data or color image data that indicates a confidential document. The former is established as predetermined image data to avoid shortcomings caused by unrestricted reproductions of confidential documents and by facsimile transmissions, and the latter is established as predetermined image data to avoid increases in cost resulting from unrestricted reproductions of color images.

A predetermined image data memory 203 and an image memory 204 are connected to the specific image detection circuit 202 as shown in FIG. 2. Sample data of predetermined image data is previously stored in the predetermined image data memory 203. In contrast, image data received from the image read processing circuit 201 is stored in the image memory 204. The specific image detection circuit 202 performs a matching process of the image data stored in both memories and then detects the predetermined image data in the image data received from the image read processing circuit 201.

Figure 3A:
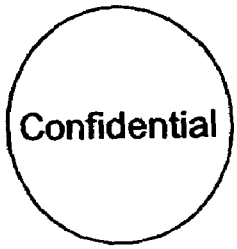
FIG. 3 (*a*) shows an example of sample data of predetermined image data stored in the predetermined image data memory of the image processing unit related to the above-mentioned embodiment.
Figure 3B:
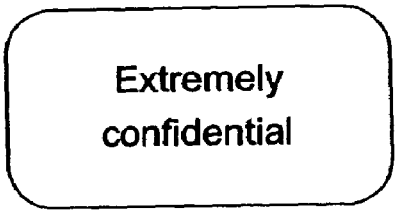
Figure 3C:
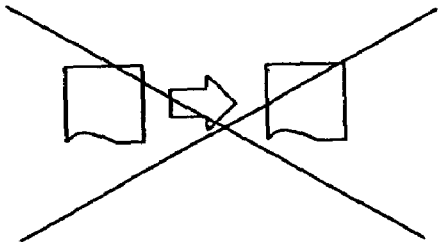

Here, sample data of predetermined image data stored in the predetermined image data memory 203 will be described. FIG. 3 shows an example of sample data of predetermined image data stored in the predetermined image data memory 203.

In this figure, sample data of predetermined image data is shown as image data that indicates a confidential document. FIG. 3 (*a*) shows predetermined image data (predetermined image data A) that includes specific characters that indicate "handle as confidential". FIG. 3 (*b*) shows predetermined image data (predetermined image data B) that includes specific characters that indicate "handle as extremely confidential". Further, FIG. 3 (*c*) shows predetermined image data that includes specific figures that indicate the meaning of "reproduction prohibited".

When the predetermined image data is color image data, the RGB components of the image data read by the reader 102 are analyzed. Then, color image data is recognized as the predetermined image data when each of these color components is equal to or more than a previously determined threshold value.

An edit/convert image processing circuit 205 performs image processing such as editing and converting image data received from the specific image detection circuit 202. In particular, the edit/convert image processing circuit 205 performs image processing such as editing and converting for the image data when functions indicated for the predetermined image data detected in image data are restricted. When performing the image processing, the edit/convert image processing circuit 205 utilizes an image memory 206 as the work area. In addition, when the image data input from the specific image detection circuit 202 is not the predetermined image data detected in image data, the edit/convert image processing circuit 205 outputs the image data to a print image processing circuit 207 without performing any image processing.

The print image processing circuit 207 performs halftone conversion processing, printing area processing, and printer conversion processing for image data received from the edit/convert image processing circuit 205. The halftone conversion processing performs a simulated progressive conversion process for the image data in proportion to the printing capacity of the printer 103. The printing area processing adds white data in a margin process and performs mask processing in a book process. The printer conversion processing converts output data so as to match the printing characteristics of the printer 103.

Figure 4:
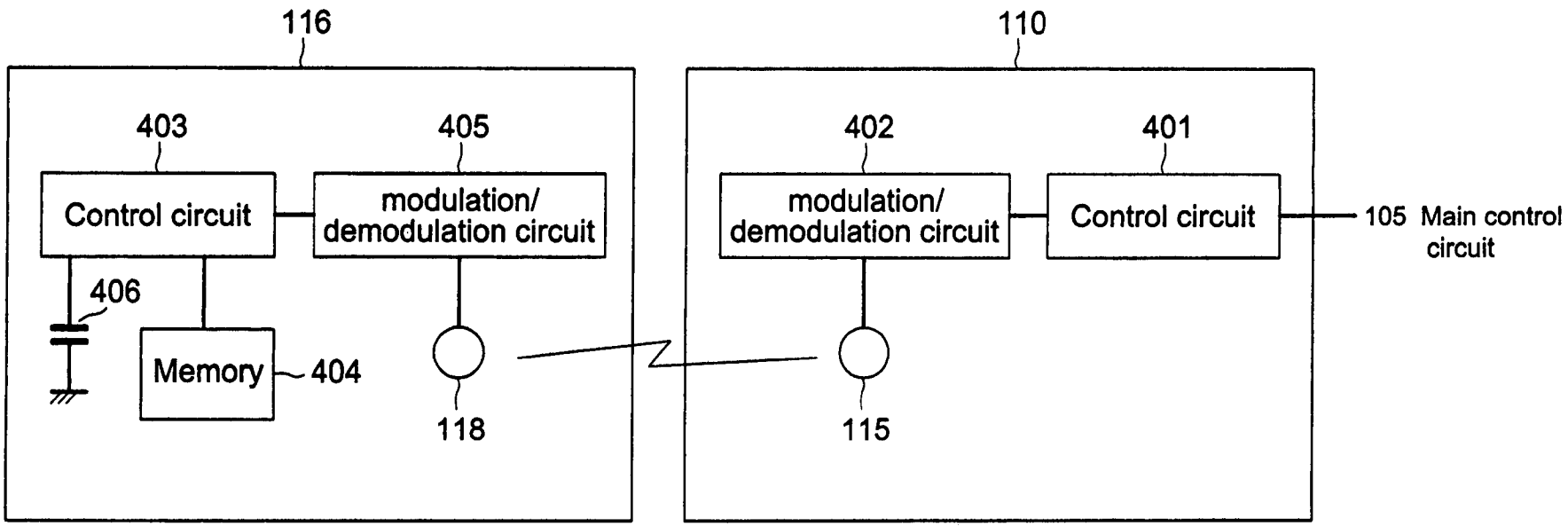
FIG. 4 is a block diagram showing the configuration of the RFID control unit that includes the control process device and the memory card that is the detection target of the RFID control unit related to the above-mentioned embodiment.

FIG. 4 is a block diagram showing the configuration of the RFID control unit 110 included in the control process device 101 and of the memory card 116 detected by the RFID control unit 110, related to this embodiment.

As shown in this figure, the RFID control unit 110 includes a control circuit 401, a modulation/demodulation circuit 402, and an antenna 115. The control circuit 401 performs control to read and write registration data (identification information of a user) stored in the memory card 116. The modulation/demodulation circuit 402 modulates signals that communicate between the memory card 116 and the control circuit 401. The signals modulated by the modulation/demodulation circuit 402 are sent to the memory card 116 through the antenna 115. On the other hand, after the signals that arrive from the memory card 116 through the antenna 115 are demodulated by the modulation/demodulation circuit 402, they are output to the control circuit 401.

In contrast, the memory card 116 includes a control circuit 403, a memory 404, a modulation/demodulation circuit 405, a capacitor 406, and an antenna 118. The control circuit 403 performs control to perform processing for registration data in the memory card 116 in response to read/write instructions from the RFID control unit 110. The memory 404 stores identification information (user ID) of users who carry this memory card 116 as registration data. The control circuit 403 reads and writes identification information stored in the memory 404 in response to instructions from the RFID control unit 10. The modulation/demodulation circuit 405 modulates signals that communicate between the RFID control unit 10 and the control circuit 403. The signals modulated by the modulation/demodulation circuit 405 are sent to the RFID control unit 110 through the antenna 118. On the other hand, after the signals that arrive from the RFID control unit 110 through the antenna 118 are demodulated by the modulation/demodulation circuit 405, they are output to the control circuit 403. The capacitor 406 accumulates electromagnetic energy supplied from the RFID control unit 10 through the antenna 118 as electrical power.

Figure 5:
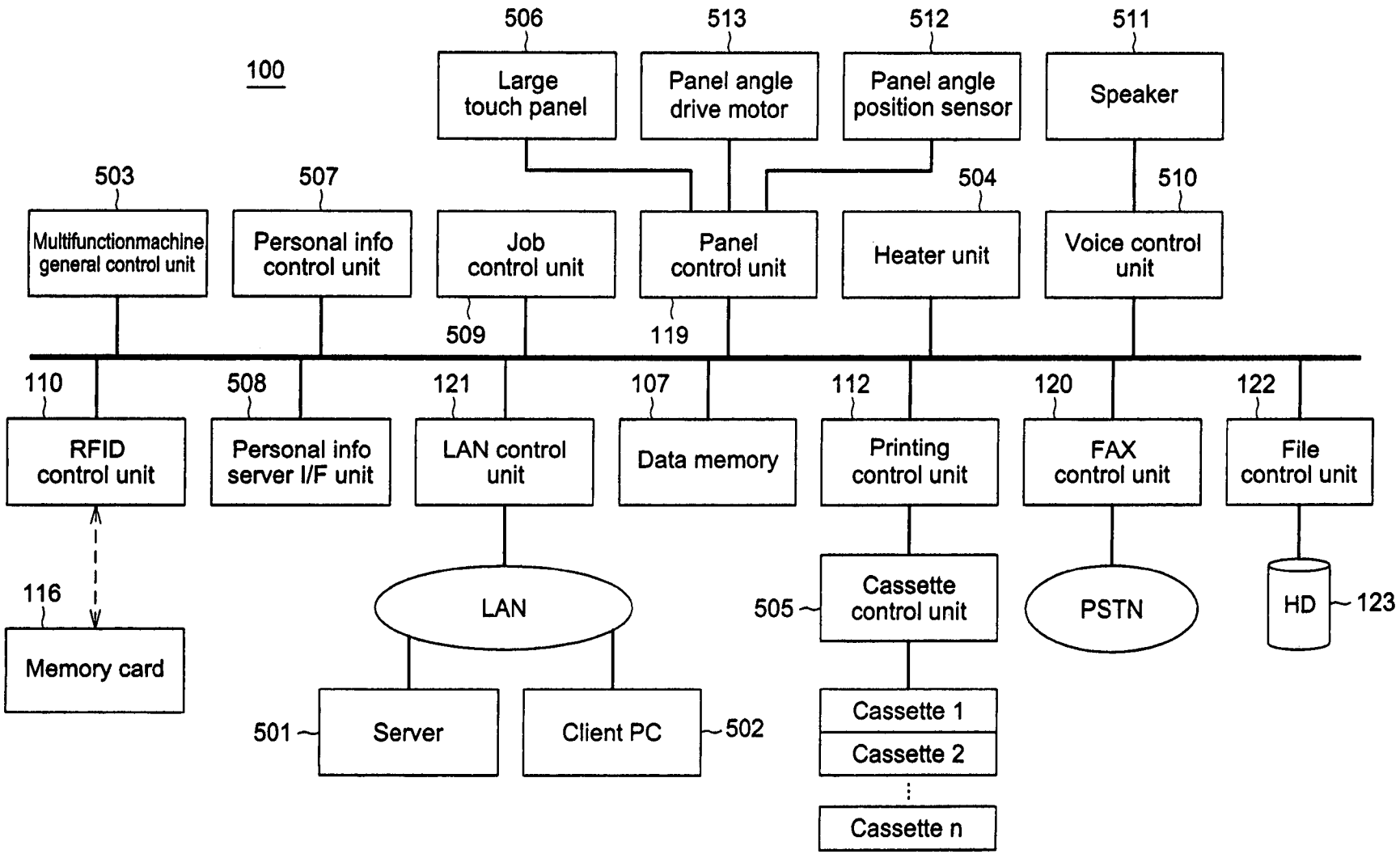
FIG. 5 is a functional block diagram of the multifunction machine related to the above-mentioned embodiment.

FIG. 5 is a functional block diagram of the multifunction machine 100 related to this embodiment. This figure shows a portion of a network. The multifunction machine 100 related to this embodiment is equipped with a printer function, a copy function, a scanner function, a FAX function, an e-mail function, and a filing function. However, the only block shown in this figure is related to the printer function, FAX function, and the filing function. In FIG. 5, the same symbols are used for the composition common to the composition shown in FIG. 1.

The multifunction machine 100 can connect to each type of server 501 and client PC through a LAN. The server 501 includes personal information servers that retain personal information tables and distribute personal authentication and personal information, and Web servers that execute jobs selected from menus using a remote procedure format.

A multifunction machine general control unit 503 is a unit that controls the entire multifunction machine 100. Control performed by the main control unit 105 and the image processing unit 109 shown in FIG. 1 are performed by the multifunction machine general control unit 503. The printing control unit 112 is a unit that performs processing to convert printing data transferred from the client PC 502 to image data in a specified format. In particular, a warm-up instruction is given to a heater unit (fixing device) 504 of an image forming unit (not shown in the figure), or a cassette select instruction is given to a cassette control unit 505. The cassette control unit 505 selects a cassette from multilevel cassettes (1) to (n) and feeds the document to the image forming unit. The FAX control unit 120 has a modem that is connected to PSTN and executes a procedure for facsimile communication. The panel control unit 119 displays an operation screen in a large touch panel 506 along with interpreting the operation content entered by the user from the touch position and displays content of the large touch panel 506.

The RFID control unit 110 has a function that reads and writes data to the memory card 116 using electromagnetic signals. When a magnetic field is applied from the RFID control unit 110 to the memory card 116, the influence (information) to the stored contents of the memory card 116 are contained in the returning magnetic field. The RFID control unit 110 detects the stored content of the memory card 116 from the returning magnetic field. Conversely, information is written by exerting magnetic variations onto the memory card 116, using electromagnetic signals applied from the RFID control unit 110 to the memory card 116. The RFID control unit 110 reads registration data from and writes to the memory card 116 within a detection vicinity with a radius of approximately 1 m, without any contact through electromagnetic signals.

A personal information control unit 507 manages the write destination of registration data read from the memory card 116. Furthermore, the personal information control unit 507 notifies the RFID control unit 110 of data written to the memory card 116. The LAN control unit 121 controls communication between the server 501 and the client PC 502 on the LAN. A personal information server I/F unit 508 performs processes for communication with the server 501 on the LAN. The data memory 107 functions as a memory unit that stores data received from the memory card 116 and server 501. A job control unit 509 sends out instructions to each applicable unit when executing each job that provides each of the functions including the copy function, the printer function, the FAX function, the scanner function, the e-mail function, and the filing function.

A voice control unit 510 retains voice data used for voice guidance. The voice control unit 510 outputs applicable voice data when a voice guidance instruction is given from the panel control unit 119 and the job control unit 509 synchronous with user operations. Although the voice guidance preferably assists operations in the operation screen which are displayed in the large touch panel 506, the voice guidance can also be other content. A panel angle position sensor 512 detects the angle of the large touch panel 506, a panel angle drive motor 513 receives control signals from the panel control unit 119, and a panel angle drive motor 513 adjusts the angle of the large touch panel 506. This embodiment allow the angle of the large touch panel 506 to be adjusted, but it is also possible to fix the angle of the large touch panel 506.

FIG. 6 shows registration information of the memory card 116.

As shown in this figure, only the user ID is stored as personal identification information. Preferably, for a security reason, the registration information of the memory card 116 should be restricted to the user ID, but other personal information should not stored. However, other personal information or group information can be stored.

FIG. 7 shows the data structure of a personal information table registered in a personal information server that functions as the server 501.

A personal information table exists for each registered user in a personal information server. As shown in this figure, a personal information table includes a user ID having personal identification information, personal information such as department to which the registered user is assigned, function information that restricts functions utilized by the registered user (hereinafter referred to as restricted function information), and history information of functions utilized by the registered user. The utilized function history information will be described later.

FIG. 8 shows an example of the composition of the restricted function information contained in a personal information table.

As shown in this figure, the restricted function information includes a function list that lists restricted functions in a list format and includes information indicating whether or not restrictions (whether or not utilization is possible) exist for each item of the function list (hereinafter referred to as utilization decision information). The utilization decision information is divided, based on the type of image data processed for each item of the function list. In this figure, the image data is divided into four types of image data: normal image data that does not include predetermined image data (normal image shown in FIG. 8), image data that includes color image data as predetermined image data (color image shown in FIG. 8), image data that includes predetermined image data A shown in FIG. 3 (*a*) (image data A shown in FIG. 8), and image data that includes predetermined image data B shown in FIG. 3 (*a*) (image data B shown in FIG. 8).

In more concrete terms, the utilization decision information and remarks of each function are registered in correspondence to each item of the function list comprised by function names and their functions. In this embodiment, "copy", "FAX", "Internet FAX/e-mail", "scanner", and "file" are registered in the function names.

A plurality of functions are registered in each function name. For example, in the function name "copy", functions such as "color copy", "monochrome copy", and "double-sided copy" are registered in that function. From among these functions, only the functions that allow utilization for image data are set to "O" in the utilization decision information indicating they are allowed.

For example, in this figure, when the image data targeted for processing is a "color image", it will not be allowed for the image data to utilize a "color copy" function of the function name "copy". On the other hand, when the image data targeted for processing is "image A" or "image B", it will be allowed for the image data to utilize the "color copy" function of the function name "copy". Furthermore, only when the image data targeted for processing is a "normal image", it will be allowed to utilize an "outside line transmission" function of the function name "FAX". On the other hand, it will not be allowed for other image data. Even further, it will be allowed for any image data to utilize a "monochrome file" function of the function name "file".

There is also a possibility that a definite number of prints (numeric value) will be set for the utilization decision as shown in the "restrict number of prints to send" function of the function name "FAX" and the "resolution restriction" function of the function name "scanner". As an example, a standard for judging the utilization decision is registered in the remarks.

Figure 9:
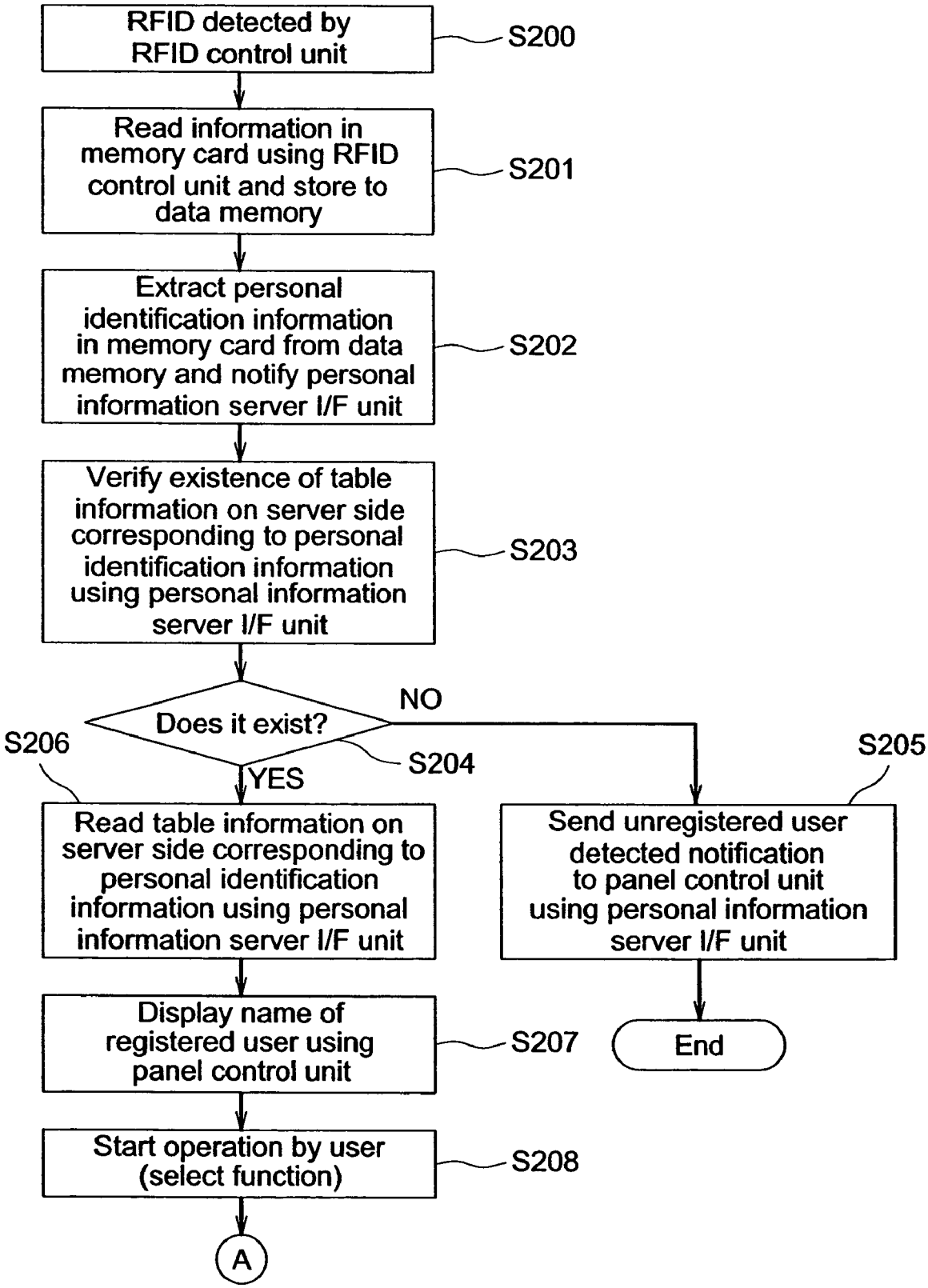
FIG. 9 is a flowchart that describes the operation when the multifunction machine related to the above-mentioned embodiment is instructed from a user to execute an operation.
Figure 10:
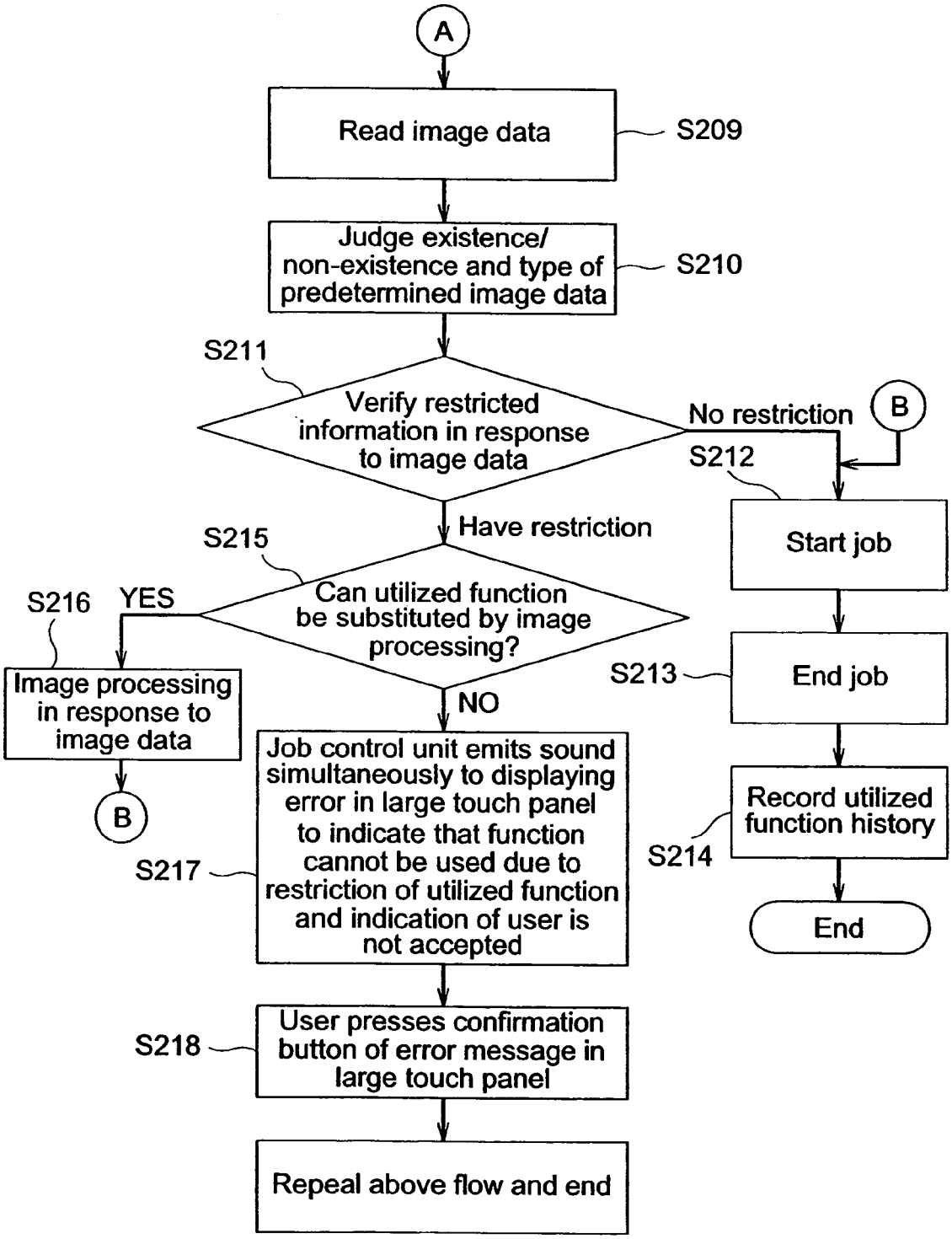
FIG. 10 is a flowchart that describes the operation when the multifunction machine related to the above-mentioned embodiment is instructed from a user to execute an operation.

Next, FIG. 9 and FIG. 10 will be used to describe actions when operations from a user are instructed to the multifunction machine 100 related to this embodiment.

When a user who instructed operations to the multifunction machine 100 and who is carrying the memory card 116 approaches the multifunction machine 100, the user is detected by the RFID control unit 110 (S200). For example, the memory card 116 which stores the identification information (user ID) of the person is inserted into an employee identification holder which an employee (user) carries. For instance, the employee identification holder hangs from their neck. When the user who is carrying the memory card 116 enters into the detection vicinity of the RFID control unit 110 (here approximately 1 m), the user ID in the memory card 116 is read by the RFID control unit 110.

The RFID control unit 110 stores, in the data memory 107, the user ID read from the memory card 116 (S201). The multifunction machine general control unit 503 reads the user ID stored in the data memory 107 and then notifies the personal information server I/F unit 508 of the user ID (S202).

As described later, when the server 501 (functioning as a personal information server) receives the user ID, the server checks whether or not it registers a personal information table of the user that coincides with the user ID and then transmits, to the multifunction machine 100, information regarding restriction exist/not exist.

The personal information server I/F unit 508 verifies whether or not the user is registered in the personal information server, based on the information regarding registration exist/not exist (203). If a personal information table of the user is not registered (S204 NO), the personal information server I/F unit 508 outputs an "unregistered user detection notification" to the panel control unit 119. When the panel control unit 119 receives the "unregistered user detection notification", it displays, in the large touch panel 506, a message indicating the machine cannot be used (S205).

In contrast, if a personal information table of the user is registered (S204 YES), the personal information server I/F unit 508 retrieves the personal information table of the detected user from the personal information server and stores the retrieved table in the data memory 107 (S206).

The panel control unit 119 extracts the name of the detected user from the personal information table stored in the data memory 107 and then displays the name in the large touch panel 506 as the person who can use the machine (S207). For example, if the name registered in the personal information of the personal information table is "Matsushita Taro", the displayed characters will be "Mr. Matsushita Taro is authenticated."

A menu screen is displayed along with the name of this detected user. Different types of function buttons to input instructions for the multifunction machine 100 are displayed in the menu screen. After this menu screen is displayed in the large touch panel 506, the user starts the operation (S208). In more detail, the user selects function buttons from the large touch panel 506 to start operations, such as color copy or outside line transmission by FAX.

When the operation starts, the multifunction machine general control unit 503 reads image data of document images targeted for processing using the reader 102 (S209). Then, the existence/non-existence of predetermined image data and the type of predetermined image data is detected in the read image data (S210). The job control unit 509 is notified of information indicating the existence/non-existence and the type of the detected predetermined image data.

When this information is received, the job control unit 509 reads the restricted function information of the personal information table of the user stored in the data memory 107. After this, it is determined whether the functions indicated by the function keys for the read image data are included in the restricted function information (S211).

When it is not included in the restricted function information, the job control unit 509 starts the job provided by the indicated function (S212). Then, when the indicated job completes (S213), the personal information server I/F unit 508 records the utilized function history in the utilized function history information in the personal information table (S214). After recording the utilized function history in the personal information table, the multifunction machine general control unit 503 ends the process.

FIG. 11 shows an example of utilized function history information in a personal information table. FIG. 11 also shows utilized function history information of a user with a user ID of "0825abX."

As shown in this figure, the utilized function history information includes the date, user ID, type of image data, and utilized functions. FIG. 11 shows that a utilized function history is registered when a color copy is made for image data that contains predetermined image data A dated Aug. 25, 2004 and also that a utilized function history is registered when a read is performed using a color scanner for image data that contains color image data dated Aug. 28, 2004.

According to the multifunction machine 100 related to this embodiment, the utilized functions and type of image data are stored in the utilized function history information when the functions are utilized for the image data in which predetermined image data detected, without restricting the functions. Thus, by reading the history of the stored information, it is always possible to monitor the state of the utilized functions for authenticated users and predetermined image data such as confidential information. As a result, risk management for predetermined image data such as confidential information can be performed.

In contrast, when the judgment of S211 determines that a function is included in the restricted function information, the multifunction machine general control unit 503 judges whether or not a substitute function can be utilized by applying image processing such as editing and converting (S215). When the substitute function can be utilized, the multifunction machine general control unit 503 performs image processing on the image data (S216). After this image processing, the multifunction machine general control unit 503 works through S212 to S214 and ends the process.

Here, it will be described that the substitute function can be utilized by applying image processing such as editing and converting. In the following, the description will use an example in which a color copy of image data that contains color image data is instructed from a predetermined user. Further, this example is one in which the data shown in FIG. 8 is registered in the personal information table of the predetermined user as restricted function information.

As shown in FIG. 8, the predetermined user can not use a color copy of image data that contains color image data. Thus, the operation of color copy will not execute for the predetermined user. As shown in this figure, however, the predetermined user can use a monochrome copy of image data that contains color image data. In this case, the multifunction machine general control unit 503 performs the monochrome copy as a substitute function after converting the color image date to monochrome image data. The multifunction machine general control unit 503 judges whether this type of substitute function can be utilized and then executes the substitute function when it is judged that the type of substitute function can be utilized.

According to the multifunction machine 100 related to this embodiment, a utilized function that can be substituted is executed according to the restricted function information when a function restricted by the restricted function information is selected by the user. Thus, it is not only possible to simply restrict the utilized functions but to also substitute functions that can be utilized. As a result, it is possible to avoid situations in which any functions can be utilized by any user without restrictions with respect to the predetermined image data detected in the image data, as well as to maintain convenience for users.

In particular, because the multifunction machine 100 related to this embodiment performs image processing required for a substitute function when it executes the substitute function, it is possible to utilize the substitute function without the user requesting special processes. As an example, required image processing is image conversion processing that converts the properties of image data. In this case, required conversion of image formats can be executed for the substitute function.

Moreover, any substitute function can be executed by a setting previously made in the multifunction machine 100 related to this embodiment. As described above, a monochrome copy of image data that contains monochrome image data can be executed as a substitute function when a color copy of image data that contains color image data is not allowed. The multifunction machine 100 also can execute, as a substitute function, a monochrome copy of image data including a deletion of a specific location (for example, a location considered to be confidential information) from image data that contains a predetermined image data A, when the monochrome copy of image data that contains the predetermined image data A is not allowed. For the former, an image processing, such as applying gradations to monochrome image data based on color image data, also can be performed.

On the other hand, when a substitute function cannot be utilized in the process of S215, the job control unit 509 outputs, to the panel control unit 119 and the voice control unit 510, an "error notification" indicating that it cannot be used due to the function restrictions. When the panel control unit 119 receives this "error notification", a message displays in the large touch panel 506 to indicate that utilization of the function is restricted. When the voice control unit 510 receives this "error notification", an error sound emits from the speaker 511. At this time, the job control unit 509 does not accept the function indicated from the user (S217).

When a function whose utilization is restricted is selected by the user, the multifunction machine 100 of this embodiment displays, in the large touch panel 506, an error message indicating that utilization of the function is restricted. Therefore, it is possible to easily recognize the function that cannot be utilized for the user and to proceed to the next process.

A confirmation button is provided in the error message displayed in the large touch panel 506. The confirmation button is used when removing the error message and returning the processing up to S208. When the error message is displayed, the user presses the confirmation button to return (S218) to the original menu screen (S208). Then, when this type of process is repeated and the job instructed from the user completes (S213) or when the user quits the operation, the job control unit 509 ends the process.

Figure 12:
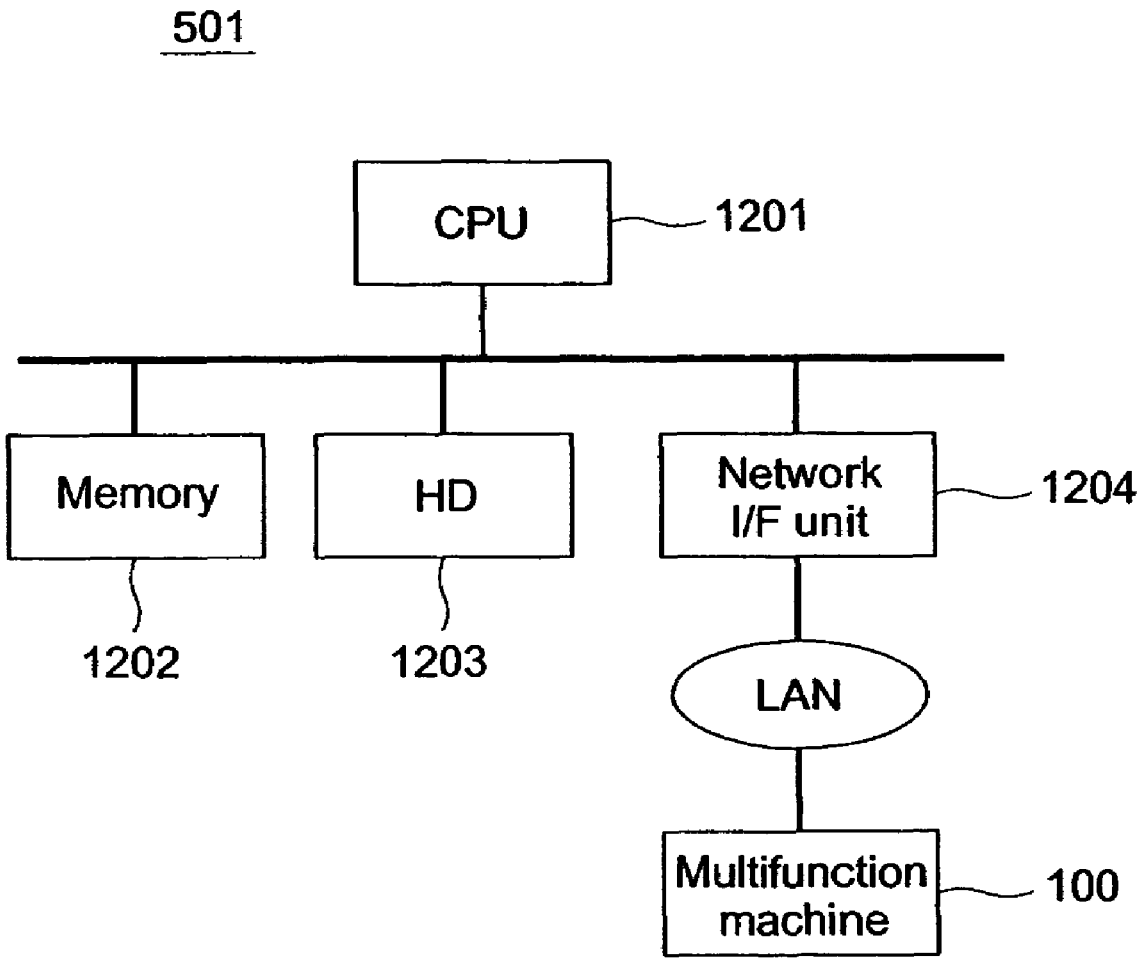
FIG. 12 is a block diagram showing a server connected to the multifunction machine related to the above-mentioned embodiment.

FIG. 12 is a block diagram showing the server 501 connected through a LAN to the multifunction machine 100 related to this embodiment. The server 501 shown in this figure includes a CPU 1201 that controls the entire machine. The memory 1202 stores control programs read by the CPU 1201 and used when controlling the entire machine, and the memory 1202 also has a function as work memory for the CPU 1201. The hard disk (HD) 1203 stores information to be distributed to the multifunction machine 100 related to this embodiment. For example, the personal information table described above is stored for each registered user when this server 501 functions as a personal information server. When functioning as a Web server, the menu for this multifunction machine 100 and the job group related to the menu are stored. The network I/F unit 1204 is an interface unit between the LAN.

Figure 13:
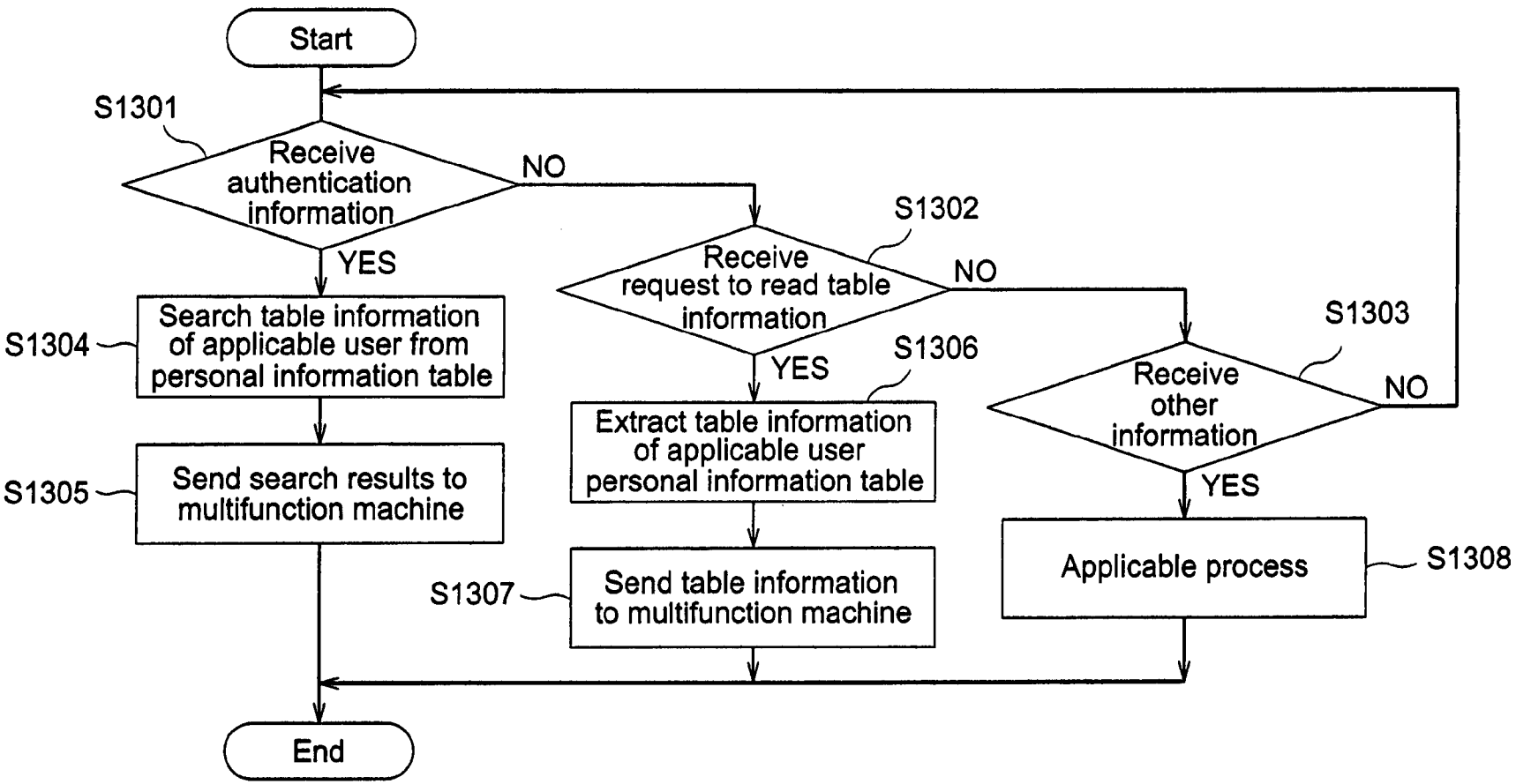
FIG. 13 is a flowchart that describes the operation of a personal authentication server connected to the multifunction machine related to the above-mentioned embodiment.

FIG. 13 is used to describe the operation when the server 501 that has the composition described above functions as a server for authenticating a user. FIG. 13 is a flowchart that describes the operation when the server 501 related to this embodiment functions as a server for authenticating the user.

When the server 501 that functions as a server for authenticating the user, the server 501 monitors, in a standby state, receipt of each type of information from the multifunction machine 100 of this embodiment. In more detail, receipt of identification information (user ID) (S1301), receipt of a request to read table information (S1302), and receipt of other information (S1303) is monitored.

When the identification information is received in S1301 while monitoring each type of information, table information of the registered user will be searched from the personal information table stored on HD 1203, based on the identification information (S1304). It is judged whether or not the received identification information is registered in the personal information table, based on the search. Then, the results of that search, namely, the existence/not-existence of identification information is sent to the multifunction machine 100 that accessed the server 501 (S1305).

On the other hand, when a request to read table information is received in S1302, the table information of the registered user will be extracted from the personal information table stored on HD 1203 (S1306). Thereby, table information of the registered user corresponding to the previously received identification information is extracted. Then, the table information is sent to the multifunction machine 100 that accessed the server 501 (S1307).

Furthermore, when other information is received in S1303, a process will be performed based on the other information (S1308). When each process in S1305, S1307, and S1308 completes, the server 501 ends the processing. In this manner, the server 501 determines the process according to each type of information received from the multifunction machine 100 and then executes the determined process.

According to the multifunction machine 100 of this embodiment, the restricted function information that was previously set for authenticated users is read from the server 501, based on the identification information (user ID) read from the memory card 116. The read restricted function information is stored in the data memory 107. Then, the multifunction machine 100 restricts the functions that the authenticated users can utilize for the image data in which the predetermined image data detected, based on the restricted function information. This makes it possible to easily restrict utilized functions for the image data in which the predetermined image data is detected, for each user for the different functions installed in the main machine. As a result, it is possible to avoid situations in which, in the main machine, any types of functions are utilized by any users without restrictions to the image data in which the predetermined image data detected.

The predetermined image data is detected from the input image data. This makes it possible to detect the data from one part of ordinary image data without sticking, to the ordinary image data, a special RFID tag in order to detect the predetermined image data. As a result, increased costs can be prevented along with preventing reductions in quality of documents that contain the predetermined image data. Further, users do not need to stick the special RFID tag to the ordinary image data.

Even further, the multifunction machine 100 related to this embodiment comprises, on the server 501, the personal information tables in where personal information is registered and reads, from the server 501, restricted function information of users corresponding to the personal identification information read from the memory card 116. Because it is not necessary to register the personal information table in the multifunction machine 100, the multifunction machine 100 can realize function utilization restrictions without preparing a high-capacity hard disk.

In particular, in the multifunction machine 100 related to this embodiment, the predetermined image data comprises a specific shape and a specific character. Thus, it is possible for the user to easily and accurately recognize that there is a specific document containing the predetermined image data as well as to simply and accurately detect the predetermined image data. The predetermined image data is also added as character image data within image data. Thus, the quality of the specific documents is not reduced. Further, the predetermined image data can comprise a specific color, such as red color. Thus, it is possible for the user to more easily and accurately recognize that there is a specific document containing the predetermined image data.

Even further, in the multifunction machine 100 related to this embodiment, the predetermined image data can comprise image data that contains color image data. Thus, it is possible for the user to more easily and accurately recognize that there is a specific document and also to easily and accurately detect the specific image.

This embodiment described when personal information and restricted function information are registered in the server 501 that functions as a personal information server and when the personal information is read and stored in the data memory 107 by the multifunction machine 100. However, the invention is not restricted to this case. For example, a storage device, such as a high-capacity hard disk, can be installed in the multifunction machine 100, and the personal information tables can be registered in the storage device and can be read from the storage device. When this type of modification is made, the multifunction machine 100 cab realize restrictions on utilizing functions by using only the multifunction machine 100.

It is noted that the foregoing examples have been provided merely for the purpose of explanation and are in no way to be construed as restricting of the present invention. While the present invention has been described with reference to exemplary embodiments, it is understood that the words which have been used herein are words of description and illustration, rather than words of restriction. Changes may be made, within the purview of the appended claims, as presently stated and as amended, without departing from the scope and spirit of the present invention in its aspects. Although the present invention has been described herein with reference to particular structures, materials and embodiments, the present invention is not intended to be restricted to the particulars disclosed herein; rather, the present invention extends to all functionally equivalent structures, methods and uses, such as are within the scope of the appended claims.

The present invention is not restricted to the above described embodiments, and various variations and modifications may be possible without departing from the scope of the present invention.

This application is based on the Japanese Patent Application No. 2004-256008 filed on Sep. 2, 2004, entire content of which is expressly incorporated by reference herein.

What is claimed is:

1. An image forming apparatus including a plurality of selective usable functions, comprising:

an input device configured to input image data;

a detector configured to detect a predetermined image data included in the input image data;

a sensor configured to transmit an electromagnetic signal to a memory card within a predetermined vicinity of the image forming apparatus and to receive identification information of the user from the memory card, the memory card being configured to be carried by a user of the image forming apparatus;

a memory configured to store predetermined function information, the predetermined function information being associated with the identification information of a predetermined user and defining functions of the image forming apparatus which the predetermined user is authorized to use; and a controller that, when the predetermined image data is detected by the detector, is configured to restrict the functions of the image forming apparatus, based on the predetermined function information stored in the memory that is associated with the identification information of the predetermined user received by the sensor, and to perform image processing on the input image data including the predetermined image data, based on the restricted functions, the controller, when the user selects a function other than the restricted functions, being further configured to select, from the restricted functions, a substitute function for the function selected by the user.

2. The image forming apparatus according to claim 1, wherein the controller performs the image processing on the input image data, based on the selected substitute function for the function selected by the user.

3. The image forming apparatus according to claim 1, wherein the controller converts an attribute of the input image data, based on the selected substitute function for the function selected by the user.

4. The image forming apparatus according to claim 3, wherein when the input image data is color image data and when the functions of the image forming apparatus are restricted to monochromatic functions, the controller converts the attribute of the input image data including the predetermined image data by converting the input color image data into monochromatic image data.

5. The image forming apparatus according to claim 1, further comprising a record memory configured to store a record regarding the input image data, wherein, when the detector does not detect the predetermined image data included in the input image data, the controller performs the image processing on the input image data without restricting functions of the image forming apparatus and stores, in the record memory, the record regarding the input image data on which the image processing is performed without restricting functions of the image forming apparatus.

6. The image forming apparatus according to claim 5, wherein the record regarding the input image data comprises at least one of a date when the image processing is performed on the input image data, a time when the image processing is performed on the input image data, a user ID, a type of the input image data, and a function utilized for performing the image processing on the input image data.

7. The image forming apparatus according to claim 1, wherein the predetermined image data comprises a predetermined symbol, the predetermined symbol indicating that the input image data is confidential.

8. The image forming apparatus according to claim 7, wherein the predetermined symbol comprises one of a predetermined character and a predetermined mark.

9. The image forming apparatus according to claim 1, wherein the predetermined image data comprises a predetermined color, the predetermined image data being detected on the input image data, based on the predetermined color.

10. An image forming apparatus including a plurality of selective usable functions, comprising:

an input device configured to input image data;

a detector configured to detect a predetermined image data included in the input image data;

a sensor configured to transmit an electromagnetic signal to a memory card within a predetermined vicinity of the image forming apparatus, the memory card being configured to be carried by a user of the image forming apparatus, and to receive identification information of the user from the memory card;

a memory configured to store predetermined function information, the predetermined function information being associated with the identification information of a predetermined user and defining functions of the image forming apparatus which the predetermined user is authorized to use; and a controller that, when the predetermined image data is detected by the detector, is configured to restrict the functions of the image forming apparatus, based on the predetermined function information stored in the memory that is associated with the identification information of the predetermined user received by the sensor, and to perform image processing on the input image data including the predetermined image data, based on the restricted functions, wherein the predetermined image data comprises a predetermined color image data, and when the predetermined color image data is resolved into RGB components, each of the RGB components exceeds a predetermined value.

11. A method for controlling an image forming apparatus, the image forming apparatus including a plurality of selective usable functions, the method comprising:

inputting image data into the image forming apparatus;

detecting a predetermined image data included in the input image data;

transmitting an electromagnetic signal to a memory card within a predetermined vicinity of the image forming apparatus, the memory card being configured to be carried by a user of the image forming apparatus;

receiving identification information of the user from the memory card;

storing predetermined function information, the predetermined function information being associated with the identification information of a predetermined user and defining functions of the image forming apparatus which the predetermined user is authorized to use;

restricting the functions of the image forming apparatus, based on the stored predetermined function information associated with the identification information of the predetermined user received from the memory, when the predetermined image data is detected;

selecting, from the restricted functions, a substitute function for the function selected by the use when a user selects a function other than the restricted functions; and performing image processing on the input image data including the predetermined image data, based on the substitute function.

* * * * *